US005149250A

United States Patent [19]

Plemmons et al.

[11] Patent Number: 5,149,250

[45] Date of Patent: Sep. 22, 1992

[54] GAS TURBINE VANE ASSEMBLY SEAL AND SUPPORT SYSTEM

[75] Inventors: Larry W. Plemmons, Fairfield; Melvin Bobo, Cincinnati, both of Ohio; Alan P. Wilds, Danvers; Gary C. Liotta, Beverly, both of Mass.

[73] Assignee: General Electric Company, Cincinnati, Ohio

[21] Appl. No.: 662,073

[22] Filed: Feb. 28, 1991

[51] Int. Cl.[5] ..... F01D 9/00

[52] U.S. Cl. ..... 415/209.3; 415/209.2

[58] Field of Search ..... 415/209.1, 209.2, 209.3, 415/138, 139, 190, 193

[56] References Cited

U.S. PATENT DOCUMENTS

| | | | |
|---|---|---|---|
| 3,302,926 | 2/1967 | Bobo | 415/209.2 |
| 3,363,416 | 1/1968 | Heybyrne et al. | 415/208.1 |
| 3,365,173 | 1/1968 | Lynch et al. | 415/209.2 |
| 3,529,906 | 9/1970 | McLaurin et al. | 415/139 |
| 3,824,034 | 7/1974 | Leicht | 415/210.1 |
| 3,909,155 | 9/1975 | Whinfrey | 415/138 |
| 4,015,910 | 4/1977 | Harmon et al. | 415/209.2 |
| 4,194,869 | 3/1980 | Corcokios | 415/216 |
| 4,384,822 | 5/1983 | Schweikl et al. | 415/138 |
| 4,492,517 | 1/1985 | Kloupas | 415/139 |
| 4,863,343 | 9/1989 | Smed | 415/138 |

FOREIGN PATENT DOCUMENTS 0018892 12/1980 European Pat. Off. ..... 415/139

*Primary Examiner*—Thomas E. Denion
*Assistant Examiner*—Michael S. Leè
*Attorney, Agent, or Firm*—Jerome C. Squillaro; John R. Rafter

[57] ABSTRACT

Apparatus for statically determinant mounting of a vane assembly in a gas turbine engine includes means for assuring contact support of the vane assembly in a predetermined number of identified locations. The vane assembly includes at least one vane extending between a radially outer nozzle band and a radially inner nozzle band. The radially outer nozzle band has axially directed load bearing elements on distal ends. The radially inner nozzle band has a radially inwardly oriented flange depending therefrom. The engine includes a radially outer support member positioned to engage the load bearing elements in the radially outer nozzle band when the vane assembly is in an operative position. A radially inner support member is incorporated in the engine for engaging the flange to axially restrain the vane assembly. The inner support member includes means for releasably connecting the flange thereto for supporting the vane assembly in radially and circumferential directions. Both the inner nozzle band and outer nozzle band have seals associated therewith for inhibiting gas flow between the respective nozzle band and the adjacent supporting members.

14 Claims, 3 Drawing Sheets

GAS TURBINE VANE ASSEMBLY SEAL AND SUPPORT SYSTEM

The present invention relates to gas turbine engines and, more particularly, to an apparatus for supporting and sealing a vane assembly of an annular nozzle in a gas flow path of a gas turbine.

BACKGROUND OF THE INVENTION

A vane assembly for a gas turbine engine typically comprises a pair of guide vanes extending between a radially outer and a radially inner nozzle band assembly. In some prior art applications, the vane assembly is secured to inner and outer support members within a gas turbine engine. However, because the inner and outer support members can expand axially and radially to different extents and because the vane assembly may be formed of a different metal material than the support members and thus subject to a different degree of thermal expansion, contact between the vane assemblies and the inner and outer support members is sometimes broken allowing high pressure cooling air to leak out into the hot gas stream passing through the nozzle formed by the vane assemblies and resulting in a loss of efficiency of the engine. One prior art attempt to overcome the gas leakage problem caused by such differential thermal expansion has involved positioning of a vane assembly within a gas turbine engine such that the assembly is free to float between the inner and outer support members. The vane assembly includes a flange extending radially inward from the inner nozzle band which flange fits within a slot formed in the inner support member. The slot is wider in the axial direction than the flange so that the vane assembly is not only free to shift position radially but is also free to tilt about the flange in order to compensate for differential axial expansion of the inner and outer support members. In order to maintain a gas seal about this floating vane assembly, the vane assembly and the adjacent surfaces of the inner and outer support members are provided with chordically extending straight sealing edges against which the vane assembly is pressed by the pressure of the gas flow against the nozzle guide vanes.

It is believed that the above described floating vane assembly is susceptible to leaks around the straight sealing edges due to the lack of restraint on the vane assembly in its assembled position. More particularly, the vane assemblies are susceptible to distortion from heat differential between leading and trailing edges of the nozzle bands. For example, FIG. 1 is a radial view of a vane assembly having an outer nozzle band 2 and a pair of nozzle vanes 3. The leading edge 4 of band 2 receives gas at a typical temperature of about 1400° F. while the gas temperature at trailing edge 5 may be about 1800° F. This 400° F. temperature differential causes the nozzle band 2 to distort or bow as indicated by dashed lines 6. Support for the vane assembly is reduced to a contact area at 7 thus allowing the assembly to rock about contact area 7. Such rocking creates steps between adjacent nozzle bands and between the nozzle band and adjacent supporting members. Gas leakage through such steps detrimentally affects engine performance. More particularly, since the vane assemblies are not restrained radially and circumferentially, the forces exerted on the vane assembly that determine the position of the vane assembly are not statically determinant.

Accordingly, gas leakage may occur around these floating vane assemblies.

SUMMARY OF THE INVENTION

It is an object of the present invention to provide apparatus for supporting and sealing a vane assembly in a gas turbine engine which overcomes the above and other disadvantages of the prior art while maintaining the flexibility of a floating system.

In accordance with one embodiment of the present invention, apparatus is provided for inhibiting gas leakage about a vane assembly positioned in a gas flow path in a gas turbine engine in which the vane assembly has at least one vane extending between a radially outer and radially inner nozzle band assembly. The radially outer nozzle band assembly has two bearing surfaces facing axially aft for supporting the outer nozzle band assembly against pressure asserted by gas in a gas flow path through the at least one nozzle guide vane in the vane assembly. The engine includes an outer support member having a load bearing surface for mating with the bearing surfaces on the outer nozzle band assembly. Each of the outer nozzle band assembly and the outer support member include sealing surfaces spaced from the bearing surfaces and defining a gap therebetween for receiving a gas seal. The inner nozzle band assembly includes a radially inward extending circumferential flange and the engine includes an inner support member oriented adjacent the flange. The inner support member has two load bearing surfaces for mating with and supporting the flange for a limited range of axial displacement of the vane assembly. Each of the inner vane assembly and the inner support member have respective sealing surfaces spaced from the bearing surface on the inner support member and oriented in opposed relationship for receiving a gas seal. The vane assembly is provided with means for releasably attaching the flange on the inner nozzle band assembly to the inner support member for inhibiting radial and circumferential motion of the vane assembly. In one form, the attaching means may comprise a pair of circumferentially spaced bolts with spacers passing through mating apertures in the flange and the support member.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
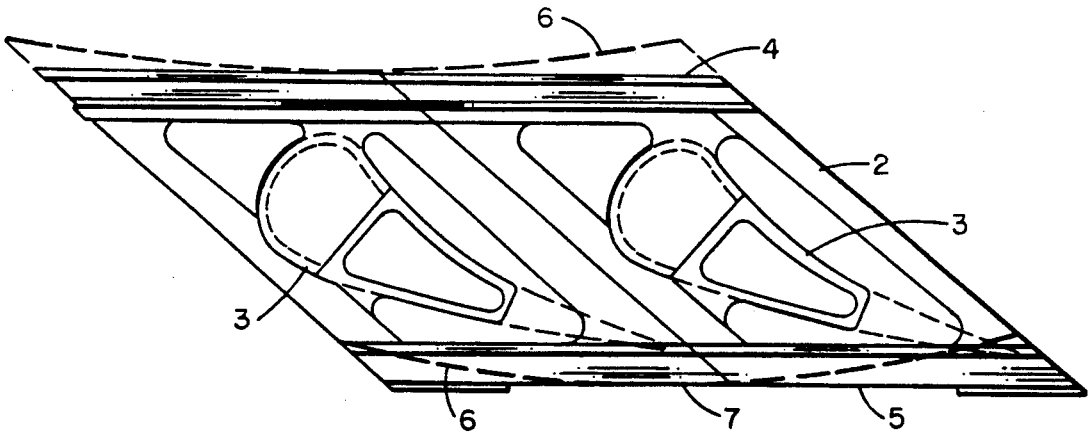
FIG. 1 is a radial view of a nozzle vane assembly illustrating thermal distortion of the assembly.
Figure 2:
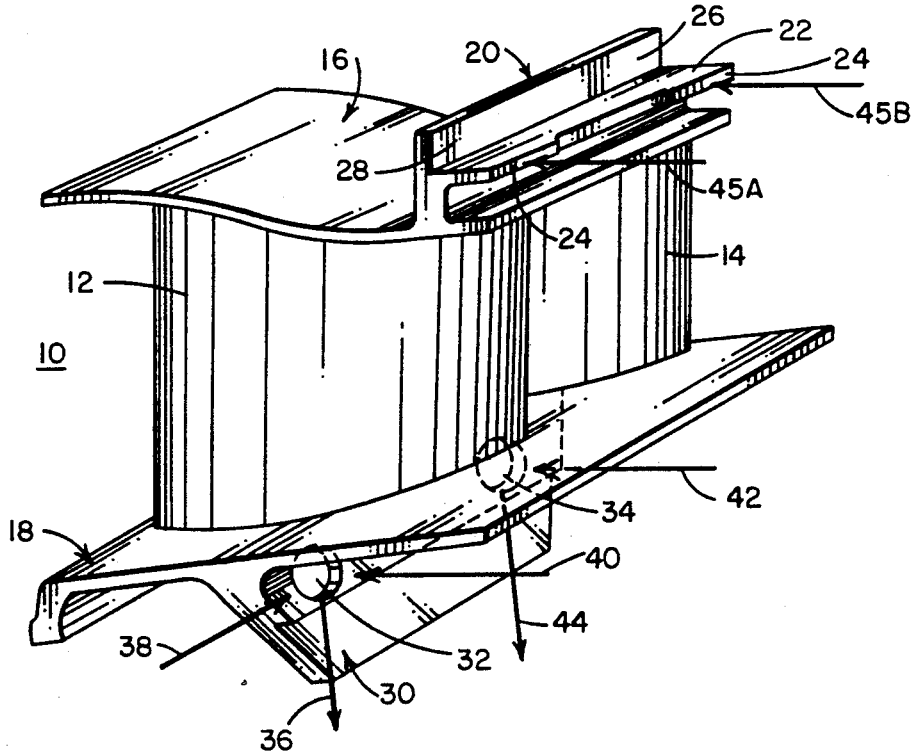
FIG. 2 is a perspective view of one form of vane assembly in accordance with the present invention.

Referring to FIG. 2, there is shown an exemplary form of vane assembly 10 comprising a pair of nozzle guide vanes 12, 14 extending between a radially outer nozzle band assembly 16 and a radially inner nozzle band assembly 18. A circumferentially extending member 20 is attached to or formed integrally with the outer nozzle band assembly and comprises a load bearing member 22 having load bearing surfaces 24 at opposite ends thereof which, as will become apparent, function as pivot points. The load bearing surfaces 24 desirably extend above the load bearing member's surface by, for example 5 mils, in order to assure contact only at the surfaces 24. The member 20 also includes a radially outwardly extending flange 26 having a machined or substantially polished and smoothed axially aft sealing surface 28. A flange 30 extends radially inward from the inner nozzle band assembly 18 and includes at least a pair of circumferentially spaced apertures 32 and 34 which are used to support the vane assembly against radial and circumferential displacement.

It will be apparent that at least six forces are required for statically positioning the vane assembly 10. A radial and circumferential force indicated by the arrows 36 and 38 can be applied, for example, at the aperture 32. A pair of circumferentially displaced axial forces indicated by the arrows 40 and 42 may be applied against the inner nozzle band assembly flange 30 to support the inner nozzle band assembly against axial displacement, preferably at raised surfaces as described with respect to surfaces 24. A force indicated by the arrow 44 may be applied at aperture 34 to counteract rotational motion of the assembly 10 about the aperture 32. At least one additional force must be applied against the outer nozzle band assembly 16 in order to counter the forces tending to tilt or rotate the vane assembly 10 about the radially inner flange 30. Preferably, as indicated by the arrows 45A and 45B, this latter force is applied at bearing surfaces 24 on opposite ends of the outer flange assembly 20. The above described forces when applied to the vane assembly 10 and appropriately controlled, statically position the vane assembly, i.e., make the orientation of the vane assembly statically determinant. As will be apparent from the following description of FIG. 2, such statically determinant positioning of the vane assembly 10 is necessary in order to assure that gas leakage provided by seals at the inner and outer nozzle band assemblies 16 and 18 is minimized and that rocking of the vane assembly from axial thermal distortion is controlled.

Figure 3:
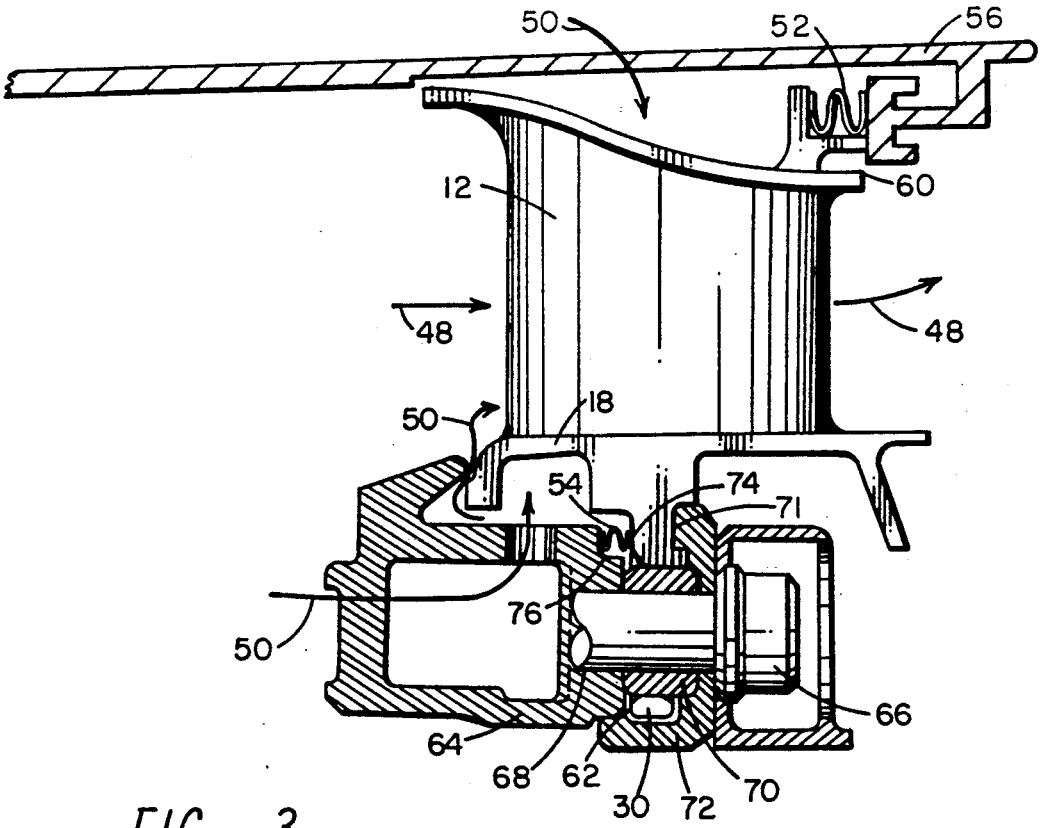
FIG. 3 is a simplified partial cross-sectional view of a turbine engine in which the vane assembly of FIG. 2 is installed.

Turning now to FIG. 3, there is shown a simplified cross-sectional view of a portion of a gas turbine engine in which the vane assembly 10 of FIG. 2 has been installed. The illustrated vane assembly 10 is shown as it would appear as the first stage of a turbine assembly following a combustor stage indicated at 46. High temperature, high pressure gases at the output of the combustion stage are directed by the nozzle guide vanes 12, 14 into downstream turbine blades (not shown) as indicated by arrows 48. Due to the high temperatures in the area of the nozzle guide vanes, it is common practice to provide cooling air, indicated by arrow 50, sometimes through hollow guide vanes in order to maintain the temperature of the vanes within the thermal limits of the material of which the vanes are constructed. It is undesirable for this cooling gas flow 50 to enter into the hot gas stream 48 since it tends to reduce the temperature of the stream and to impair the efficiency of the engine. For this reason, sealing means 52, 54 are provided at the outer nozzle band assembly and the inner nozzle band assembly, respectively, to block the flow of high pressure cooling air into the gas stream. The forces indicated by the arrows 45A and 45B, operative on the flange 20 attached to the outer nozzle band assembly 16, are provided by an outer support member 56 coupled to an engine frame member (not shown) and having a load bearing surface 60 positioned to mate with the load bearing surfaces 24 on the outer flange load bearing member 22. The radially inward extending flange 30 attached to the inner nozzle band assembly 18 sits within a slot 62 formed by an inner support member 72 which has bushings 70 which control the space between 72 and 64.

While the engine herein is shown in cross-section, it will be appreciated that each of the elements extend circumferentially with the inner and outer support members 64 and 56 extending in annular fashion about the gas turbine engine. The axial direction, as the term is used herein, refers to a direction substantially parallel to the direction of gas inlet flow 48 as indicated by the arrows. The radially outward direction refers to a direction perpendicular to the axial direction.

The forces indicated by the arrows 36, 38, and 44 are implemented by means of pins such as bolts 66 with bushings 70 extending through the apertures 32, 34 in the inner flange 30. Mating apertures 68 are formed in the inner support member 64 through which the bolts 66 pass. The slot 62 is wider than the flange 30 so that a controlled amount of axial displacement and pivoting of the vane assembly 10 is provided within the confines of the slot 62. Bushings 70 are preferably placed in the apertures 32, 34 and sized to fit on the bolts 66 so as to provide for sliding axial displacement of the flange 30 and associated vane assembly 10 to support assembly 10 without clamping so that the vane assembly can tilt in an axial direction about the flange 30. An annular bearing member 72 is supported on the bushings 70 by the bolt 66 clamping load and forms one side of the slot 62 for mating with and supporting the inner flange 30 against axial displacement. Under load, i.e., during gas turbine engine operation, the forces generated by the gas flowing through the nozzle guide vanes 12, 14 force the vane assembly 10 aft of the engine causing the load indicated by the arrows 40 and 42 to be absorbed by the bearing member 72. The forces 45A, 45B at the outer nozzle band assembly are absorbed by contact between bearing surfaces 24 and member 56. However, the bearing surfaces are not required to provide sealing of the gas flow path about the nozzle band assemblies. Rather, pressure loaded auxiliary seals 52, 54 provide gas sealing. The auxiliary seals may be resilient W-shaped spring members 52, 54 as illustrated or pressure loaded leaf seals. At the inner nozzle band assembly 18, annular spring member 54 bears against a sealing surface 74 on a forward side of the inner flange 30. The seal member 54 is captured between the flange 30 and a circumferential groove 76 forming part of the inner support member 64 and positioned substantially parallel to the flange 30. The width of groove 76 also defines the limits for pivoting motion of vane assembly 10. An aft side of groove 76 is machined or formed to have a relatively smooth sealing surface for mating with the spring 54.

As can be appreciated, when the gas turbine engine is in operation, the hot gas flow 48 through the nozzle guide vanes 12, 14 will force the vane assembly 10 towards the aft end of the engine. The inner nozzle band assembly 18 has a predetermined limited degree of axial motion on the bolts 66 and bushings 70 and thus will slide until the flange 30 is restrained by contact with the load bearing member 72. The outer nozzle band assembly 16 is restrained by contact at the load bearing surfaces 24 when the member 22 on the outer nozzle band assembly contacts the outer support member 56. If there is any differential axial expansion between the inner support member 64 and the outer support member 56, the vane assembly 10 has a limited degree of axial tilt which will allow the outer support member 56 to maintain contact with the bearing member 22 on the outer nozzle band assembly. However, it is not critical that the contact be such as to maintain a sealing interface since the actual gas seal is provided by the seal member 52 (and seal member 54) but it is necessary that the four contact points be made in order to stabilize the assembly. Both of the seal members 52, 54 are resilient, pressure loaded seals which maintain a good sealing interface since the distance between the opposing sealing surfaces remains substantially constant even though differential growth occurs.

Figure 4:
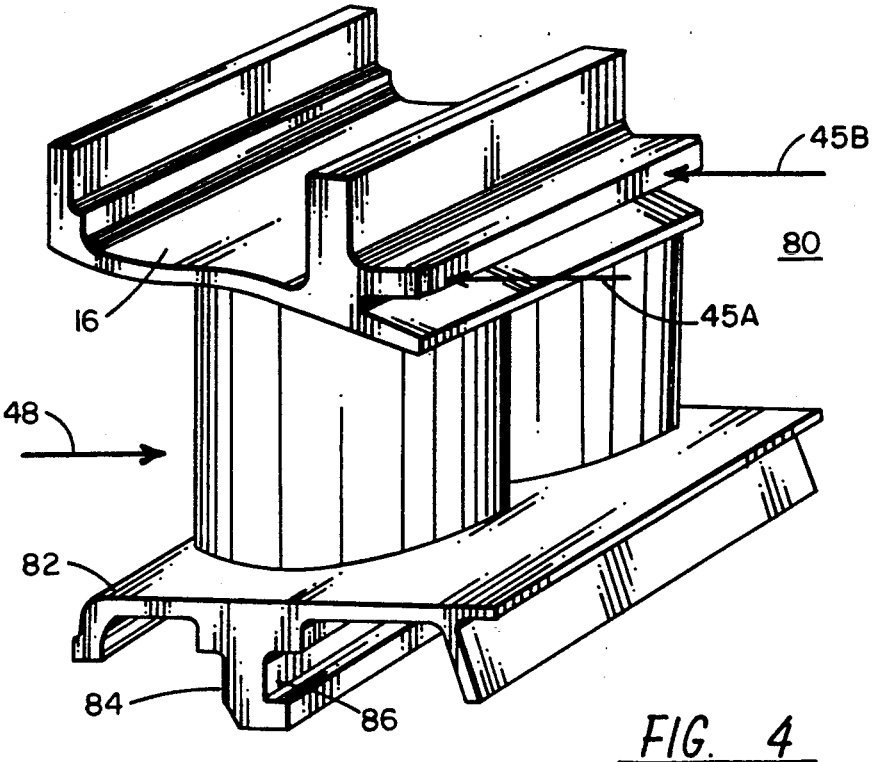
FIG. 4 is a perspective view of another form of nozzle vane assembly.
Figure 5:
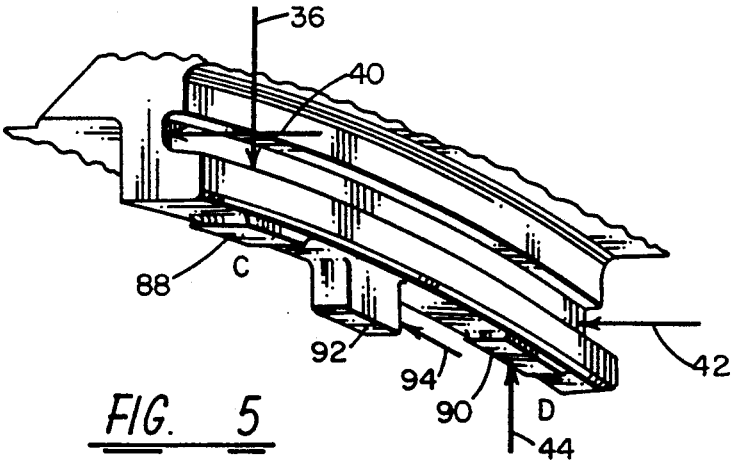
FIG. 5 is a perspective view of the radially inner flange of the vane assembly of FIG. 4.

FIGS. 4 and 5 illustrate an alternate mounting system for a nozzle vane assembly 80 in which a radially inner nozzle band 82 incorporates a circumferential flange section 84 having a circumferentially extending groove or slot 86. The flange section 84 terminates below the slot 86 and includes a pair of circumferentially spaced pads 88, 90 formed on the radially inner surface of the flange section. Between the pads 88, 90 is a tongue 92 extending radially inward which is used to inhibit circumferential motion of the vane assembly.

As with the previously described embodiment, the nozzle assembly is statically determinate through six degrees of freedom. The forces necessary to retrain the nozzle are indicated by arrows 45A, 45B at the outer nozzle band, by arrows 40, 42 at opposite ends of the inner flange section 84, and by arrows 36 and 44 reacting radially within slot 86 and against pad 90, respectively. In addition, a circumferential force 94 reacts against tongue 92 to inhibit circumferential motion. An important feature of pads 88 and 90 is that a line drawn between the two pad bearing surfaces should be parallel to a line drawn between the bearing surfaces of pads 45A and 45B. Keeping these rocking planes parallel eliminates arc-drop as the nozzle rocks under gas loads. The arrangement of FIGS. 4 and 5 also has reduced radial height at the inner flange 84 which minimizes thermal stresses and provides a reduced heat path into the engine support structure. Preferably, all the surfaces at which forces are applied are raised with respect to adjacent surfaces to assure contact and support at only those surfaces.

Figure 6:
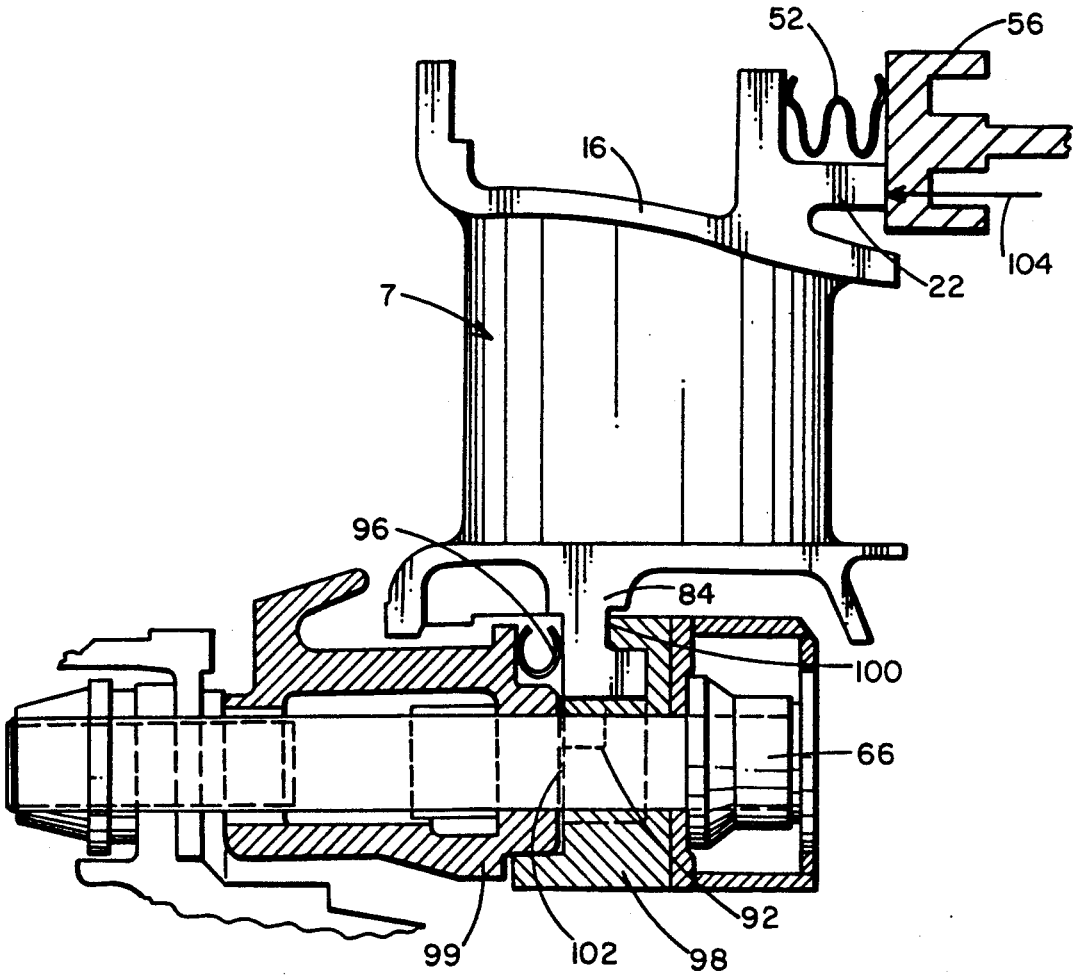
FIG. 6 is a simplified cross-sectional view of the vane assembly of FIG. 4 installed in a gas turbine engine.

FIG. 6 is a partial cross-sectional view illustrating mounting of the vane assembly of FIG. 4. The radially outer nozzle band is substantially the same as nozzle band 16 of FIG. 3 and utilizes essentially the same sealing technique with a W-shaped spring 52. However, it will be understood that other types of resilient seals could be used at this interface, including, for example, a leaf spring forced into sealing contact by gas pressure in the area above the nozzle band 16. Similarly, a leaf spring could be used to replace the inner spring 54 although a U-shaped spring 96 is shown in FIG. 6.

The bolt 66 in combination with a bearing member 98 are used to support the vane assembly at its radially inner flange section 84 with respect to nozzle support 99. The bearing member 98 differs from member 72 in having a tongue 100 which fits within slot 86 and in having a plurality of circumferentially spaced apertures for receiving respective ones of the tongues 92. In this embodiment, the slot 86 and tongue 100 establish spacing to permit pivoting of the vane assembly. In addition, the tongue 100 and slot 86 are sized to allow sufficient pivoting so that flange 22 contacts support member 56. The system also incorporates sufficient clearance at area 102 adjacent tongue 91 to allow the nozzle to pivot about the contact point between tongue 100 and the bottom of slot 86 until restrained by the outer load stop at 104.

What has been described is a novel apparatus for supporting a vane assembly within a gas turbine engine in conjunction with a sealing arrangement which allows a controlled amount of flex or motion of the vane assembly without affecting the sealing arrangement. While the vane assembly is allowed to pivot or rock about the inner flange, it does so to a controlled degree without affecting the slots in which the seals are positioned. Furthermore, the seals, either W-shaped, U-shaped, or leaf springs, are arranged to compensate for any distortion of the vane assembly and maintain a sealing interface with adjacent support members. Still further, the mounting arrangement for the vane assembly provides a statically determinant mounting means which assures control of tilting and rocking while preventing radial and circumferential motion of the vane assembly.

While the invention has been described in what is presently considered to be a preferred embodiment, other variations and modifications will become apparent to those skilled in the art. It is intended, therefore, that the invention not be limited to the illustrative embodiment but be interpreted within the full spirit and scope of the appended claims.

What is claimed is:

1. Apparatus for statically determinant mounting of a vane assembly in a gas turbine engine, the vane assembly including at least one vane extending between a radially outer nozzle band and a radially inner nozzle band, the radially outer nozzle band having axially directed load bearing elements on distal ends thereof and the radially inner nozzle band having a radially inward oriented flange depending therefrom, the engine including a radially outer support member positioned to engage the load bearing elements in the radially outer nozzle band when the vane assembly is in an operative position and further including a radially inner support member for engaging the flange to axially restrain the vane assembly, the inner support member including means for releasably connecting the flange thereto for supporting the vane assembly in radial and circumferential directions and further including seal means operatively coupled between said radially outer nozzle band and said radially outer support member for inhibiting gas flow therebetween, the seal means including a radially outwardly extending flange connected to said radially outer nozzle band and a corresponding flange extending from the engine substantially parallel to said radially outwardly extending flange, a resilient seal being positioned between said radially outwardly extending flange and said corresponding flange.

2. The apparatus of claim 1 and including seal means operatively coupled between said inner nozzle band and said inner support for inhibiting gas flow therebetween.

3. The apparatus of claim 1 wherein said connecting means comprises at least a first and a second bolt passing through a respective one of a pair of spaced apertures in said radially inner support member, said apertures in said flange being sized to slide on said bolts to provide axial motion of said vane assembly.

4. The apparatus of claim 3 and including bushings in each of said apertures in said flange for slidably mating with said bolts and provides a controlled spacing for supporting said flange for pivotable motion.

5. The apparatus of claim 2 wherein said seal means comprises a radially extending flange on said inner support member substantially parallel to said flange on said inner nozzle band and a resilient seal position between said support member flange and said nozzle band flange.

6. The apparatus of claim 4 wherein said bushings and said apertures in said flange are cooperative when said vane assembly is in an assembled position to accommodate axial motion of said vane assembly and provide for a controlled degree of tilting of said vane assembly about said flange.

7. The apparatus of claim 1 wherein said connecting means comprises a tongue and groove coupling between said flange and said radially inner support member.

8. Apparatus for inhibiting gas leakage about a vane assembly in a gas flow path in a gas turbine engine, the vane assembly having at least one vane extending between a radially outer and a radially inner nozzle band assembly, the radially outer nozzle band assembly having at least one bearing surface facing axially aft for supporting the outer nozzle band axially against pressure asserted by gas in the gas flow path, the engine including an outer support member having a load bearing surface for mating with the bearing surface on the outer nozzle band assembly, each of the outer nozzle band assembly and the outer support member including sealing surfaces spaced from the bearing surfaces and defining a gap therebetween for receiving a gas seal, the inner nozzle band assembly including a radially inwardly extending circumferential flange and the engine including an inner support member oriented adjacent the flange and having at least one load bearing surface for mating with and supporting the flange for a limited range of axial displacement, each of the inner nozzle band assembly and the inner support member having respective sealing surfaces spaced from the bearing surface on the inner support member and oriented in opposed relationship for receiving a seal therebetween, and means for releasably attaching the flange on the inner nozzle band assembly to the inner support member for inhibiting radial and circumferential motion of the vane assembly.

9. The apparatus of claim 8 wherein the attaching means allows axial displacement of the vane assembly.

10. The apparatus of claim 9 wherein the attaching means comprises at least a pair of circumferentially spaced pins extending through mating apertures in each of the inner support member and the flange on the inner nozzle band.

11. The apparatus of claim 10 wherein the inner support member includes a circumferential slot and the flange on the inner nozzle band assembly is positioned within the slot with the vane assembly in an assembled position.

12. The apparatus of claim 8 wherein the sealing surface on the inner nozzle band assembly is formed on a forward surface of the flange, the inner support member having a circumferential lip extending radially therefrom substantially parallel with the forward surface of the flange, the inner support member sealing surface being formed on the lip.

13. The apparatus of claim 12 wherein the seal comprises a resilient spring seal.

14. Apparatus for statically determinant mounting of a vane assembly in a gas turbine engine, the vane assembly including at least one vane extending between a radially outer nozzle band and a radially inner nozzle band, the radially outer nozzle band having axially directed load bearing elements on distal ends thereof and the radially inner nozzle band having a pair of spaced load bearing elements thereon, the engine including a radially outer support member positioned to engage the load bearing elements in the radially outer nozzle band when the vane assembly is in an operative position and further including a radially inner support member for engaging the pair of spaced load bearing elements to axially restrain the vane assembly, the inner support member including means for releasably connecting the flange thereto for supporting the vane assembly in radial and circumferential directions and further including seal means operatively coupled between said radially outer nozzle band and said radially outer support member for inhibiting gas flow therebetween, the seal means including a radially outwardly extending flange connected to said radially outer nozzle band and a corresponding flange extending from the engine substantially parallel to said radially outwardly extending flange, a resilient seal being positioned between said radially outwardly extending flange and said corresponding flange.

* * * * *